United States Patent [19]

Lepisto

[11] Patent Number: 4,574,720

[45] Date of Patent: Mar. 11, 1986

[54] METHOD AND APPARATUS FOR FILLING VALVED BAGS

[75] Inventor: J. George Lepisto, Middletown, Ohio

[73] Assignee: Champion International Corporation, Stamford, Conn.

[21] Appl. No.: 648,785

[22] Filed: Sep. 6, 1984

[51] Int. Cl.[4] ..... B65B 1/04

[52] U.S. Cl. ..... 141/10; 141/46; 141/68; 141/93; 141/286

[58] Field of Search ..... 141/10, 114, 67, 68, 141/313-317, 1-9, 11, 12, 37-66, 392, 93, 83, 89, 90, 286

[56] References Cited

U.S. PATENT DOCUMENTS 4,311,173 1/1982 Sailors ..... 141/68

4,387,749 6/1983 Donisi ..... 141/68

*Primary Examiner*—Houston S. Bell, Jr.

*Attorney, Agent, or Firm*—Evelyn M. Sommer; William W. Jones

[57] ABSTRACT

Bags having a filling valve sleeve which are adapted for containing pulverulent material are filled by inserting a filler nozzle into the sleeve and blowing the material through the nozzle and then through an entry port in the sleeve into the bags. The filler nozzle has a transversely flattened configuration which conforms to the shape of the valve sleeve. The valve sleeve has an inner end which is closed and formed devoid of deep corners and the filler nozzle has a nose portion which is formed so as to conform in profile to the inner end of the sleeve. The entry port of the sleeve is disposed in the bottom wall thereof and the filler nozzle has a delivery port in its bottom wall which registers with the sleeve entry port. The valve sleeve has an inner plastic film lining, and the filler nozzle has a groove which surrounds the nozzle delivery port to which groove a vacuum is applied so as to draw the plastic lining into sealing engagement with the filler nozzle.

5 Claims, 4 Drawing Figures

METHOD AND APPARATUS FOR FILLING VALVED BAGS

This invention relates to a method and apparatus for filling bags having sleeve valves with a pulverulent material. In particular, this invention relates to such a method and apparatus which involves the use of a specially configured filler spout or nozzle.

Bags which contain pulverulent or powdery material, such as cement, fertilizer, chemicals, and the like have been formed with two closed ends and with an accessible filler sleeve at one corner of the bags. To fill such bags, an elongated filling nozzle which is connected to a supply of the pulverulent material is inserted into the filler sleeve. The sleeve will have an internal entry port which provides fluid communication between the interior of the sleeve and the interior of the rest of the bag. The filling nozzle has a delivery port which registers with the sleeve entry port when the nozzle is inserted into the sleeve. The pulverulent product is blown into the bag, passing through the nozzle delivery port and the sleeve entry port. The nozzle is then withdrawn from the sleeve whereby the latter collapses and closes to prevent the product from exiting the bag via the sleeve.

In the past, problems have presented themselves relating to sifting of the product from the interior of the sleeve to the ambient surroundings. This sifting is the result of product being deposited in the interior of the sleeve during filling or subsequently thereto. A solution to this problem is found in copending U.S. patent application Ser. No. 424,893, filed Sept. 28, 1982 to J. George Lepisto. This solution involves the steps of suspending any of the product remaining in the nozzle and in the sleeve with pressurized air delivered thereinto after the bag is filled, and then drawing a vacuum through the nozzle to suck the suspended product out of the sleeve via the nozzle. An improvement to this solution is disclosed in copending U.S. patent application Ser. No. 540,378 filed Oct. 11, 1983 to J. George Lepisto, which utilizes a transversely flattened filling nozzle which closely conforms in configuration to the sleeve to enhance the desired tight fit between the nozzle and sleeve, and which also provides for the drawing of a vacuum at the exterior of the nozzle in grooves formed therein which partially surround the delivery port of the nozzle. The evacuated grooves serve to enhance the ability of the nozzle to evacuate product left in the sleeve by distributing the vacuum about the interior of the sleeve.

This invention relates to a further improvement of the apparatus for removing product from the interior of the sleeve by vacuum, and also further limiting the amount of product which will be deposited in the sleeve interior during filling. In accordance with this invention, the filling spout is formed with the transversely expanded configuration to conform closely with the cross-sectional shape of the sleeve. The inner end of the sleeve is formed with a transverse closure which is devoid of deep corners in which product can be trapped, and the nose of the nozzle is formed with a like configuration to fit snugly in the inner end of the sleeve. The sleeve is provided with an entry port in its bottom wall, i.e., the wall of the sleeve which faces the interior of the bag, and the nozzle is provided with a delivery port which registers with the entry port of the sleeve when the nozzle is inserted into the sleeve. The sleeve is provided with a plastic film lining, such as polyethylene, or the like, in a conventional manner. The nozzle includes a groove formed in its outer surface, which groove completely surrounds the delivery port of the nozzle and is outwardly spaced therefrom. The nozzle is also provided with vacuum tubes which communicate with ports opening into the external groove in the nozzle. After the nozzle has been inserted into the sleeve preparatory to filling the bag, a vacuum is drawn in the vacuum tubes and thence in the external groove in the nozzle. This vacuum sucks the polyethylene liner in the sleeve into sealing engagement with the exterior of the nozzle along a line which completely surrounds the entry port of the sleeve and the delivery port of the nozzle. This vacuum seal prevents material which is being blown into the bag via the delivery and entry ports of the nozzle and sleeve from filtering into the remainder of the sleeve. Thus, the amount of material which is deposited in the sleeve during the filling operation is sharply reduced. After the bag has been filled, the vacuum in the nozzle groove is removed, and the nozzle is partially withdrawn from the sleeve. A second vacuum is then drawn in the product delivery passage of the nozzle and thence via the delivery port into the interior of the sleeve. This second vacuum sucks any product which may have filtered into the sleeve out of the sleeve as the nozzle is withdrawn completely from the sleeve.

It is, therefore, an object of this invention to provide a method and apparatus for filling valve sleeve bags with pulverulent product.

It is a further object of this invention to provide a method and apparatus of the character described wherein depositing of the product in the valve sleeve is minimized during the filling operation.

It is an additional object of this invention to provide a method and apparatus of the character described wherein product which is deposited in the valve sleeve during filling of the bag is removed therefrom by vacuum after the filling operation is completed.

These and other objects and advantages of the invention will become more readily apparent from the following detailed description of a preferred embodiment of the invention when taken in conjunction with the accompanying drawings in which.

Figure 1:
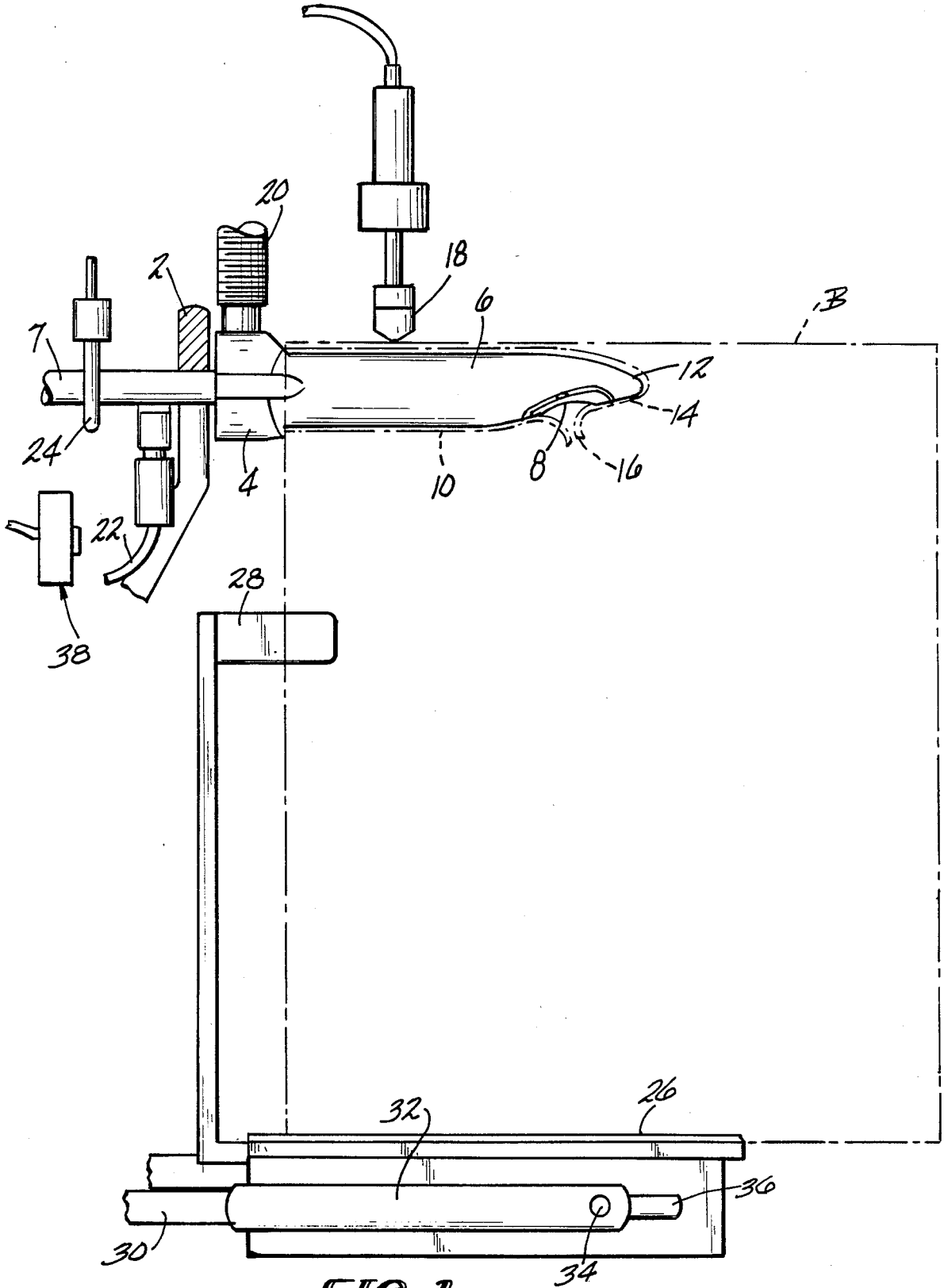
FIG. 1 is a fragmented side elevational view of a preferred embodiment of an apparatus formed in accordance with this invention.

Referring now to the drawings, there is shown in FIG. 1 a preferred embodiment of an apparatus formed in accordance with this invention for filling bags which are equipped with sleeve valves with pulverulent product. The apparatus includes a frame 2 (shown fragmentarily) on which is mounted a fitting 4. A product filling nozzle 6 is connected to the fitting 4, as is a product feed tube 7. It will be understood that the feed tube 7 is connected to a source of the product and to a source of positive pressure which, when activated, entrains the product and delivers it to the interior of the bag B (shown in phantom). The product passes from the feed tube 7 into a delivery passage within the nozzle 6 to exit the nozzle 6 through a delivery port 8 in the nozzle 6. The nozzle 6 is shown fully inserted into the valve sleeve 10 (shown in phantom) of the bag B so that the nose 12 of the nozzle 6 snugly nests into the inner closed end 14 of the sleeve 10. The sleeve 10 includes an entry port 16 formed in its lower surface as, for example, by a pair of intersecting slits formed in the sleeve 10. A bag clamp 18 disposed above the filling nozzle 6 is operable to selectively clamp and unclamp the bag B to the nozzle 6. A flexible hose 20 is connected to the fitting 4 for drawing a first vacuum in the nozzle 6, as will be explained in greater detail hereinafter, and a second flexible hose 22 is connected to the feed tube 7 for drawing a second vacuum within the nozzle 6, as will be explained in greater detail hereinafter. A clamp 24 straddles the feed tube 7 and is selectively operable to close and open the feed tube 7 to passage of product therethrough. The apparatus also includes a saddle 26 which underlies the bottom of the bag B and which has a pusher 28 connected thereto. The saddle 26 is selectively reciprocated by a piston 30 with the reciprocal movement being supported by a guide 32 having rollers 34 which ride in a slot 36 in the saddle 26. An on-off switch 38 controls operation of the apparatus. The various components of the apparatus may be controlled by a plurality of pneumatic or electrical switches which are within the state of the art and are not specifically disclosed.

Figure 2:
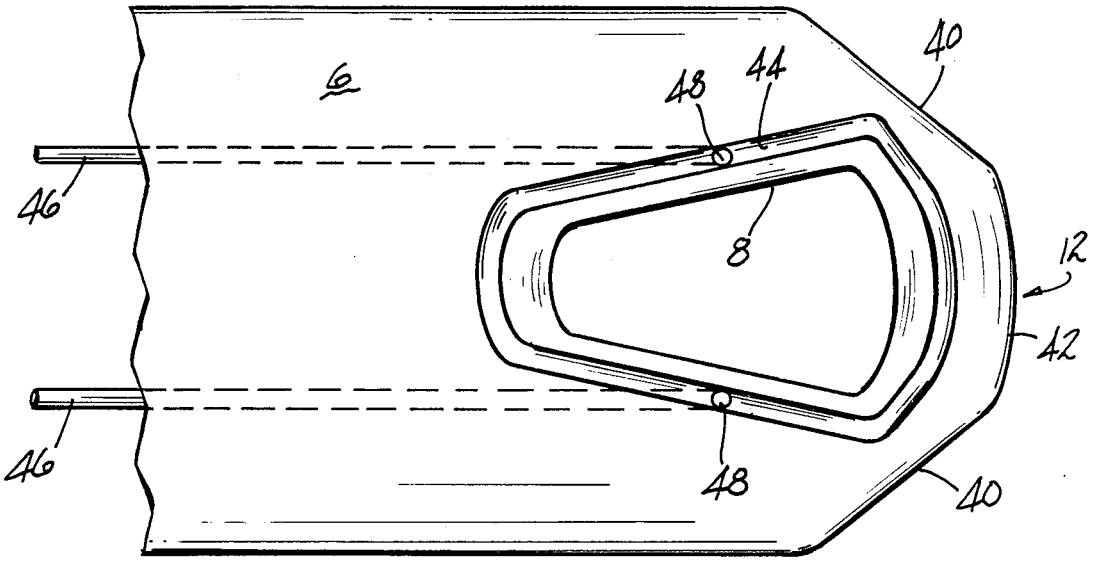
FIG. 2 is a fragmented bottom elevational view of the filling nozzle utilized on the apparatus of FIG. 1.
Figure 3:
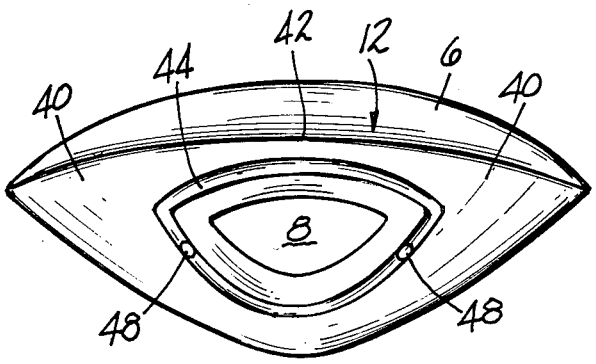
FIG. 3 is an elevational view of the nose end of the filling nozzle of FIG. 2.

Referring now to FIGS. 2 and 3, details of the filling nozzle 6 are shown. The nozzle 6 takes the form of a transversely flattened ellipse which closely conforms in shape to the interior of the bag sleeve. The nose 12 of the nozzle 6 is relatively pointed with marginal converging portions 40 which merge into a relatively narrow central portion 42. A groove 44 is formed in the outer surface of the bottom wall of the nozzle 6, which groove 44 is outwardly spaced from the edges of the delivery port 8 and completely surrounds the delivery port 8. A pair of vacuum tubes 46 are disposed inside of the nozzle 6 and open into the groove 44 through ports 48. The tubes 46 communicate with the first vacuum hose 20.

Figure 4:
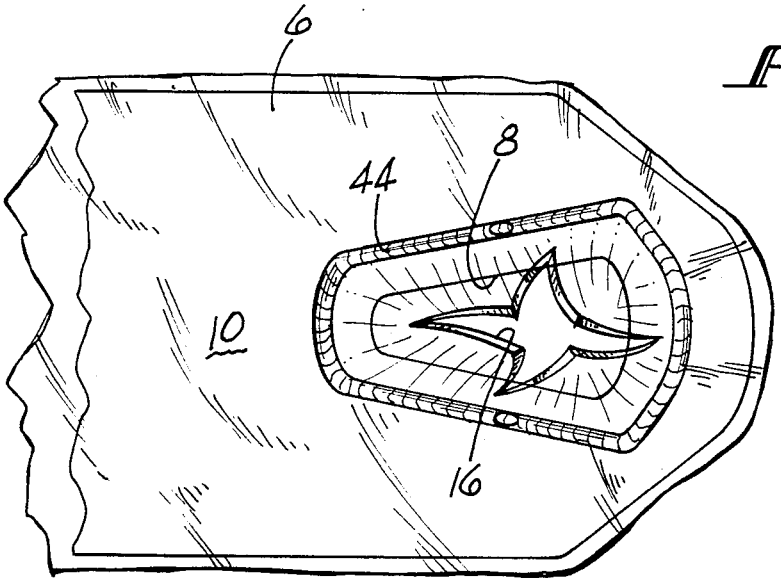
FIG. 4 is a fragmented perspective view of the nose end of the nozzle shown telescoped into the valve sleeve of the bag as the vacuum is drawn to seal the portion of the sleeve surrounding the entry port from the remainder of the interior of the sleeve.

The apparatus operates as follows. The machine operator fits an empty bag onto the nozzle 6, as shown in FIG. 1, and actuates the startup switch 38. The clamp 18 descends to clamp the bag B onto the nozzle 6. The vacuum source connected to the hose 20 is activated drawing a vacuum in the tubes 46 and thus in the groove 44 on the exterior of the nozzle 6. The vacuum thus drawn in the groove 44 sucks the polyethylene sleeve liner 10 into sealing engagement with the exterior of the nozzle 6, as shown in FIG. 4, along a line which completely surrounds the delivery port 8 on the nozzle 6 and the entry port 16 in the sleeve liner 10. The sealing action protects the remainder of the interior of the sleeve from collecting product as the latter is blown into the bag. The positive pressure impeller connected to the delivery tube 7 is then actuated to impel product through the tube 7, the nozzle 6, the delivery port 8 and the entry port 16 into the interior of the bag B. The apparatus is equipped with a conventional weight sensor which senses when the bag B is filled with the proper weight of product. When this filled condition is sensed, the impeller is interrupted, the bag clamp 18 is lifted to release the bag B, the clamp 24 is actuated to close off the delivery tube 7, and the vacuum in the hose 20 is turned off. When the bag B has filled, the entry port 16 closes itself automatically. The piston 30 is then actuated to move the saddle 26 and pusher 28 to the right as shown in FIG. 1 so as to slide the bag B partially off of the nozzle 6. The vacuum to the hose 22 is actuated so as to draw a vacuum in the hose 22 and in the interior of the nozzle 6. This vacuum sucks any product out of the interior of the sleeve which may have been deposited there during the filling operation. The vacuum is continued as the bag B is pushed off of the nozzle 6 by the pusher 28 so that the entirety of the inside of the sleeve can be vacuumed free of product. The filled bag is then placed on a conveyor or the like, the vacuum in the hose 22 is turned off, and the clamp 24 is opened to open the feed tube 7. The saddle 26 and pusher 28 are returned to their initial positions and a new empty bag is fitted into the nozzle 6. The filling procedure is then repeated.

It will be readily appreciated that the apparatus and method of this invention will minimize the amount of product deposited in the bag filler sleeve during the filling operation and will also provide for removal of substantially all of the product which may nevertheless be deposited in the sleeve.

Since many changes and variations of the disclosed embodiment of the invention may be made without departing from the inventive concept, it is not intended to limit the invention otherwise than as required by the appended claims.

I claim:

1. An apparatus for filling a bag of the type having a filling sleeve providing access for impelling pulverulent product into the interior of the bag, said apparatus comprising:

(a) a filling nozzle having a transversely flattened configuration which closely conforms to the shape of the sleeve, said nozzle further having a nose portion with converging side portions which merge with a central portion, and said nozzle having a delivery port which aligns with an entry port on the sleeve when said nozzle is fully inserted into the sleeve;

(b) a groove formed on an external surface of said nozzle, said groove being outwardly spaced from and completely surrounding said delivery port;

(c) vacuum conduit means in said nozzle, said vacuum conduit means communicating with said groove;

(d) first vacuum means for drawing a vacuum in said vacuum conduit means and said groove to draw a portion of the sleeve into sealing engagement with the exterior of said nozzle along a line which completely surrounds said delivery port of said nozzle and the entry port of the sleeve; and (e) second vacuum means for drawing a vacuum to said nozzle after the vacuum from said first vacuum means is released.

2. The apparatus of claim 1 further comprising means for partially withdrawing said nozzle from the sleeve subsequent to release of said first vacuum means and prior to activation of said second vacuum means.

3. The apparatus of claim 2, wherein said means for partially withdrawing is operable to completely withdraw said nozzle from the sleeve after said second vacuum means is activated.

4. An apparatus for filling a bag of the type having a filling sleeve providing access for impelling pulverulent product into the interior of the bag, said apparatus comprising:

(a) a filling nozzle adapted to be inserted into the bag filling sleeve, said nozzle having a delivery port which aligns with an entry port on the sleeve when said nozzle is fully inserted into the sleeve;

(b) a groove formed on an external surface of said nozzle, said groove being outwardly spaced from and completely surrounding said delivery port;

(c) vacuum conduit means in said nozzle, said vacuum conduit means communicating with said groove;

(d) first vacuum means for drawing a vacuum in said vacuum conduit means and said groove to draw a portion of the sleeve into sealing engagement with the exterior of said nozzle along a line which completely surrounds said delivery port of said nozzle and the entry port of the sleeve; and (e) second vacuum means for drawing a vacuum in said nozzle after the vacuum from said first vacuum means is released.

5. A method for filling a bag of the type having a filling sleeve, said method comprising the steps of:

(a) inserting a filling nozzle into said filling sleeve of said bag so as to bring a delivery port on said nozzle into alignment with an entry port on said sleeve;

(b) drawing a first vacuum between said filling nozzle and said filling sleeve to form a seal line wherein said sleeve is in sealing engagement with said nozzle along a line spaced outwardly from and completely surrounding said delivery port and said entry port;

(c) impelling a pulverulent product through said nozzle, said delivery port and said entry port into the interior of said bag to fill said bag with said product;

(d) releasing said first vacuum;

(e) partially withdrawing said nozzle from said filling sleeve;

(f) drawing a second vacuum in said nozzle to suck product deposited in said filling sleeve out of said filling sleeve through said nozzle; and (g) completely withdrawing said nozzle from said filling sleeve while maintaining said second vacuum.

* * * * *